US005409105A

United States Patent [19]

Appelbaum et al.

[11] Patent Number: 5,409,105

[45] Date of Patent: Apr. 25, 1995

[54] DISPLAY PACKAGE WITH A SUBSTANTIALLY TRANSPARENT WINDOW FOR VIEWING AN ARTICLE

[75] Inventors: Marc Appelbaum, Allendale, N.J.; David Neuberg, Lawrence, N.Y.

[73] Assignee: Gold Force International, Ltd., New York, N.Y.

[21] Appl. No.: 112,673

[22] Filed: Aug. 26, 1993

[51] Int. Cl.[6] ..... A45C 11/04

[52] U.S. Cl. ..... 206/6.1; 206/45.14; 206/45.19; 206/45.31; 53/449; 53/474

[58] Field of Search ..... 206/6.1, 45.14, 45.16, 206/45.19, 45.31, 293, 566, 814; 53/449, 474

[56] References Cited

U.S. PATENT DOCUMENTS

| | | | |
|---|---|---|---|
| Re. 32,296 | 11/1986 | Wynalda | 206/814 |
| 2,676,699 | 4/1954 | Friedman | 206/45.19 |
| 3,587,837 | 6/1971 | Smith | 206/45.14 |
| 3,656,612 | 4/1972 | Sellors | 206/45.31 |
| 4,016,972 | 4/1977 | Szamborski | 206/45.14 |
| 4,043,449 | 8/1977 | Love | 206/45.14 |
| 4,043,450 | 8/1977 | Rielly | 206/45.14 |
| 4,355,758 | 10/1982 | Lavery | 206/43.31 |
| 4,514,961 | 5/1985 | Gillie | 53/449 |
| 4,739,353 | 4/1988 | Heuer et al. | 206/45.31 |
| 4,915,224 | 4/1990 | Wulf et al. | 206/45.31 |

*Primary Examiner*—David T. Fidei
*Attorney, Agent, or Firm*—Steinberg, Raskin & Davidson

[57] ABSTRACT

A display package includes an outer enclosure having a see-through window for viewing an article to be displayed. The article is retaining in a display means. The display means is arranged in the bottom of a box which fits within the outer enclosure. A box top dimensioned to fit over and close the bottom of the box is also containing in the outer enclosure, but is positioned such that it does not obstruct the view of the article through the see-through window.

23 Claims, 5 Drawing Sheets

DISPLAY PACKAGE WITH A SUBSTANTIALLY TRANSPARENT WINDOW FOR VIEWING AN ARTICLE

BACKGROUND OF THE INVENTION

The present invention relates generally to display packages and, more particularly, to a display package with a substantially transparent window for viewing an article to be sold and a method of displaying and storing such an article.

Conventional packages and conventional methods of packaging commercial products usually do not provide for ways of permitting a consumer to view the product from within the package without having to remove the product from its packaging. The illustration or drawings from the packages may not provide an adequate representation of the actual product being purchased. In addition, consumers are hesitant to purchase any item unless it has properly been scrutinized. Packages that do provide for displays of the commercial product have numerous setbacks. These packages are either too flimsy to withstand the stress placed upon them during their shipment or are too expensive to manufacture since the material used or the process applied are costly. Therefore, manufacturers, packages, wholesalers and retailers are continually seeking to find new and improved packages which are both durable against the rigors of the shipment process and functional in allowing a customer to easily see the product which (s)he is interested in purchasing.

The packaging industry is also searching for methods of prepackaging articles for sale. A pre-packaged commercial product allows for convenience and time efficiency. If an article to be sold is pre-packaged, a store attendant can remove that packaged article from the shipment box and place the package directly onto sales counters, shelves or display racks of department stores or supermarkets for immediate sale.

It would further be extremely desirable to provide a display package which also serves as a gift box for the article.

SUMMARY OF THE INVENTION

Accordingly, it is an object of the present invention to provide new display packages with a see-through or substantially transparent window for viewing an article to be sold.

A further object of the present invention is to provide new display packages which also serve as gift boxes for the articles being sold.

A further object of the present invention is to provide a method of displaying and storing an article to be sold.

Yet another object of the present invention is to provide a method of pre-packaging articles for sale.

In accordance with the above objects and others, the present invention relates in part to a display package having a substantially transparent or see-through window for viewing an article for sale. The display package comprises an outer enclosure having a substantially transparent display window. The outer enclosure contains a display means which retains and displays an article for sale. The display means is arranged within the outer enclosure at a position whereby the article can be viewed through the display window. The display means comprises of the bottom of a box. The outer enclosure further contains a top of a box which is dimensioned to fit onto the bottom of the box when the top and bottom of the box are removed from the outer enclosure. When the top of the box is fitted onto the bottom of the box, the article retained in the display means cannot be viewed. The now-closed box serves as a gift box which can be, for example, covered with wrapping paper by the purchaser. In certain embodiments, outer surfaces of at least the top of the box are pre-covered with gift-wrapping, or are otherwise made "fancy" so that they are suitable to be presented as a gift without the need for further decoration.

The outer enclosure comprises a bottom wall, a top wall and side walls which are connected to the top and bottom walls. The substantially transparent display window is situated on at least one of the side walls of the upper enclosure.

The bottom of the box contained within the outer enclosure comprises a bottom and connected side walls which form an open top portion or cavity wherein the article to be displayed is situated. In certain preferred embodiments, the display means comprises retaining means for maintaining the article to be displayed in an appropriate position. The box top contained within the outer enclosure comprises a top wall and connected side walls which form an open bottom portion or cavity. Upon removal of the box top and bottom from the outer enclosure, the box top is preferably dimensioned such that the side walls of the box top fit over the side walls of the bottom of the box when the box top is placed atop the bottom of the box. This allows the top and bottom of the box to serve as a gift box for the article. The article displayed by the package can be, e.g., a article of jewelry.

In accordance with other embodiments of the invention, the package further comprises means for attaching the first box to a display rack.

The present invention also provides for a method of storing and displaying an article to be sold. The method comprises retaining an article to be displayed and sold on a display means which comprises the bottom of a box; arranging the display means within an outer enclosure having a substantially transparent window, in a position whereby the display means is aligned with the substantially transparent window to facilitate viewing of the article therethrough; and enclosing a box top within the outer enclosure along with the bottom of the box.

The method further comprises structuring the box top to fit atop the bottom of the box, to thereby enclose the article upon removal of the box top and bottom from the outer enclosure. The packages of the present invention may be removably attached to display racks at the point of sale, or may even be left in the shipment box for sale, as long as the shipment box has been modified to allow the potential purchaser to view the article to be sold through the see-through display window.

BRIEF DESCRIPTION OF THE DRAWINGS

The following drawings are illustrations of embodiments of the invention and are not meant to limit the scope of the invention as encompassed by the claims.

DETAILED DESCRIPTION OF THE PREFERRED EMBODIMENT

Figure 1:
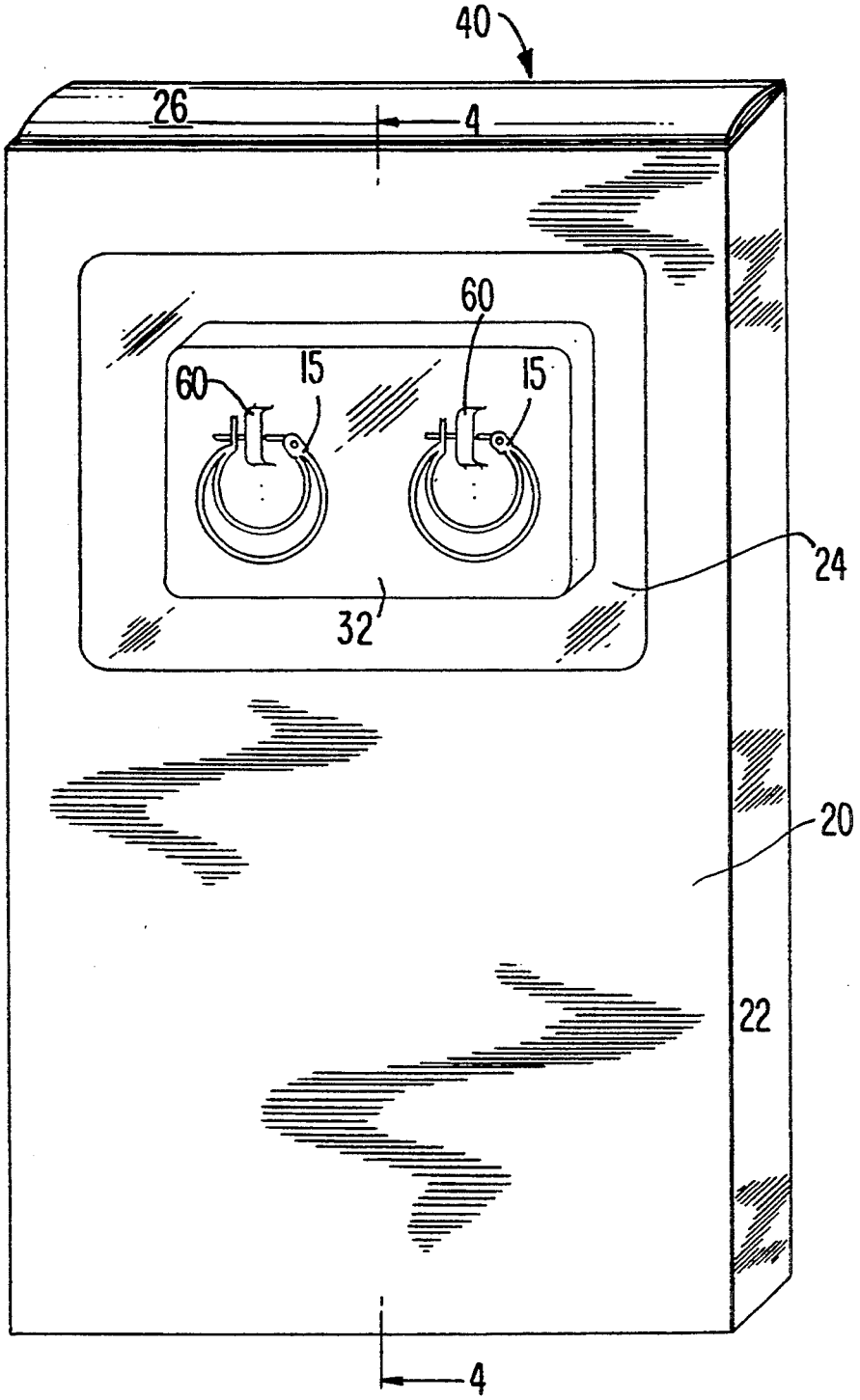
FIG. 1 is a perspective view of the display package with a substantially transparent or see-through window for viewing an article in accordance with the present invention.
Figure 2:
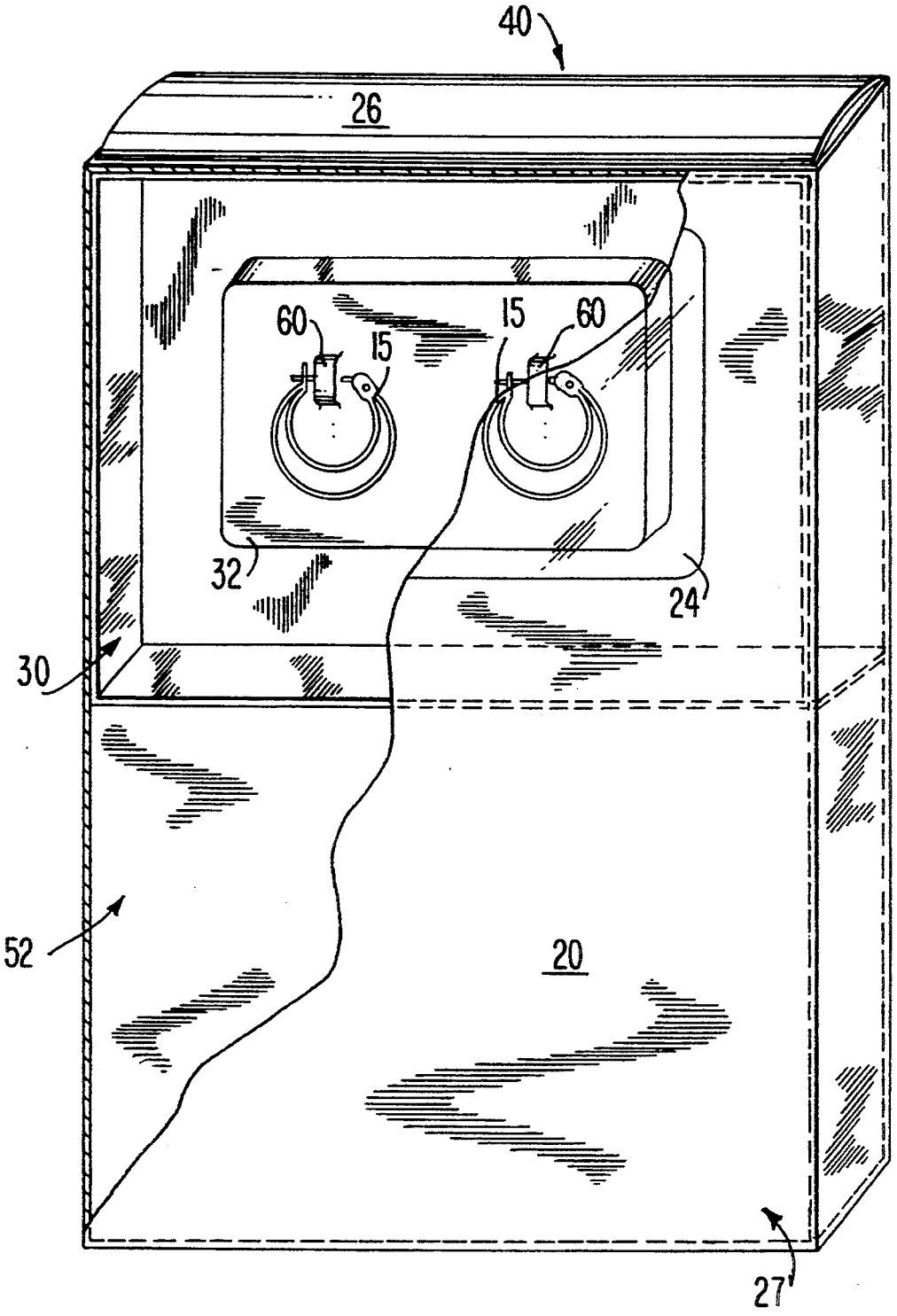
FIG. 2 is a perspective view of the display package, partially broken away, which shows the display means and the top and bottom of the box.
Figure 3:
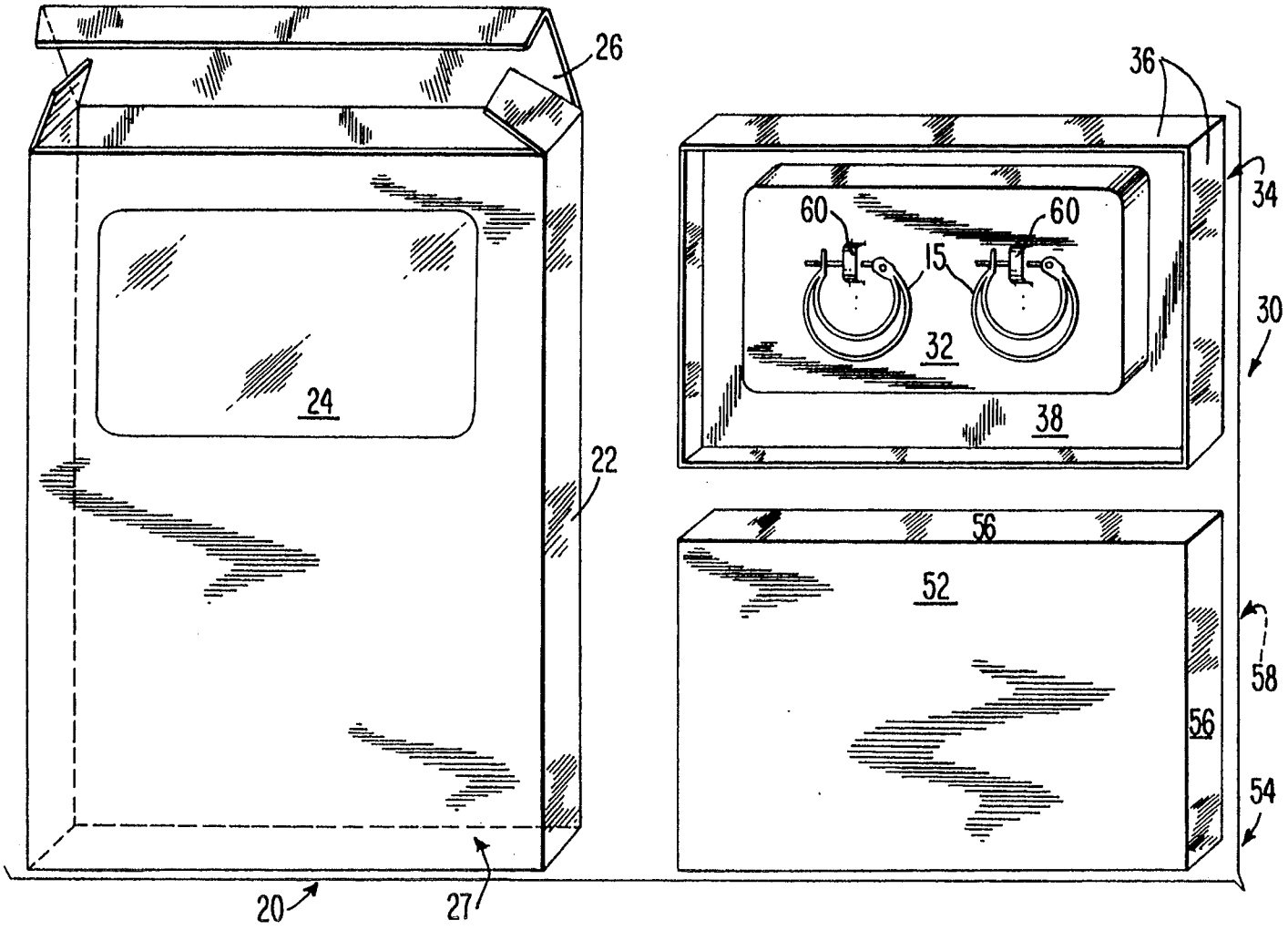
FIG. 3 is an exploded perspective view of the outer enclosure and the elements to be placed therein.

Referring now to the drawings wherein like reference characters designate identical or corresponding parts throughout the several views, and more particularly to FIGS. 1–3, a display package with a substantially transparent or see-through window for viewing an article, generally designated (40), comprises an outer enclosure (20) having a substantially transparent display window (24). The display window (24) is preferably a light-weight see-through material, such as a plastic. However, it may be composed of any suitable material known to those skilled in the art. Alternatively, the display window may not be "closed", thus comprising an opening in one of the walls comprising the outer enclosure. This would allow a potential purchaser to touch the article to be displayed.

The outer enclosure (20) contains a display means (32) holding an article (15) to be displayed. The display means (32) is arranged within the outer enclosure (20) such that the article (15) can be viewed through the substantially transparent display window (24). The outer enclosure (20) may be made of any suitable material known to those skilled in the art, including plastic, cardboard, etc.

The display means (32) comprises the bottom of a box (30). The outer enclosure (20) further contains a box top (54).

The outer enclosure (20) can comprise a top wall (26), a bottom wall (27) and side walls (22). The side walls (22) are connected to the top wall (26) and bottom wall (27) of the outer enclosure (20). The substantially transparent display window (24) is situated on at least one of the side walls (22).

In accordance with certain embodiments of the invention, the bottom (30) of the box comprises a base (34) and side walls (36). The side walls (36) are connected to the base (34), such that a cavity (38) is formed. A display means (32) may be located in the cavity, which display means (32) retains and displays the article (15). The box top (54) can comprise a top wall (52) and side walls (56). The side walls (56) are connected to the top wall (52) of the box top, thereby forming an upper cavity (58) therein. The bottom and top of the box may be made of any suitable materials known to those skilled in the art. Cardboard, which is opaque, is especially preferred.

Figure 4:
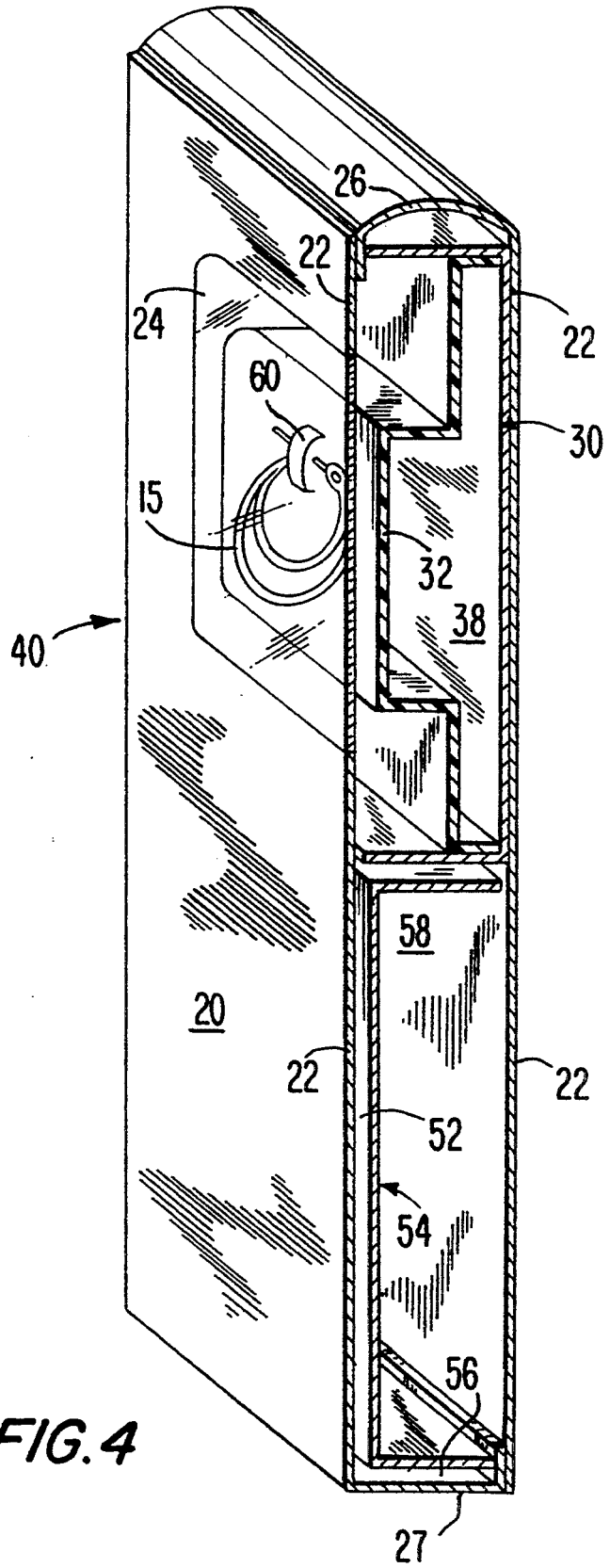
FIG. 4 is a perspective cross sectional view taken along lines 4—4 of FIG. 1.

Referring now to FIG. 4, in assembly, the box top (52) is arranged within the outer enclosure (20) and is encased by the bottom wall (27) and side walls (22) of the outer enclosure (20). The display means (32) comprising the bottom of the box (28) is also arranged within the outer enclosure (20) and is encased by the side walls (22) and top wall (26) of the outer enclosure (20).

In certain preferred embodiments of the present invention, the bottom of the box (30) is supported within the outer enclosure (20) by the box top (54) in a position such that the display means (32) is aligned with the substantially transparent display window (24) of the outer enclosure (20). This enables the article (15) to be viewed through the substantially transparent window (24).

In other embodiments of the invention, the box top (54) may be fitted onto the bottom of the box (30) such that the top wall (52) of the box top (54) is in close proximity to or contacting the base (34) of the bottom (30). This may be desirable when space is a factor and the outer enclosure must be dimensioned as small as possible.

Figure 5:
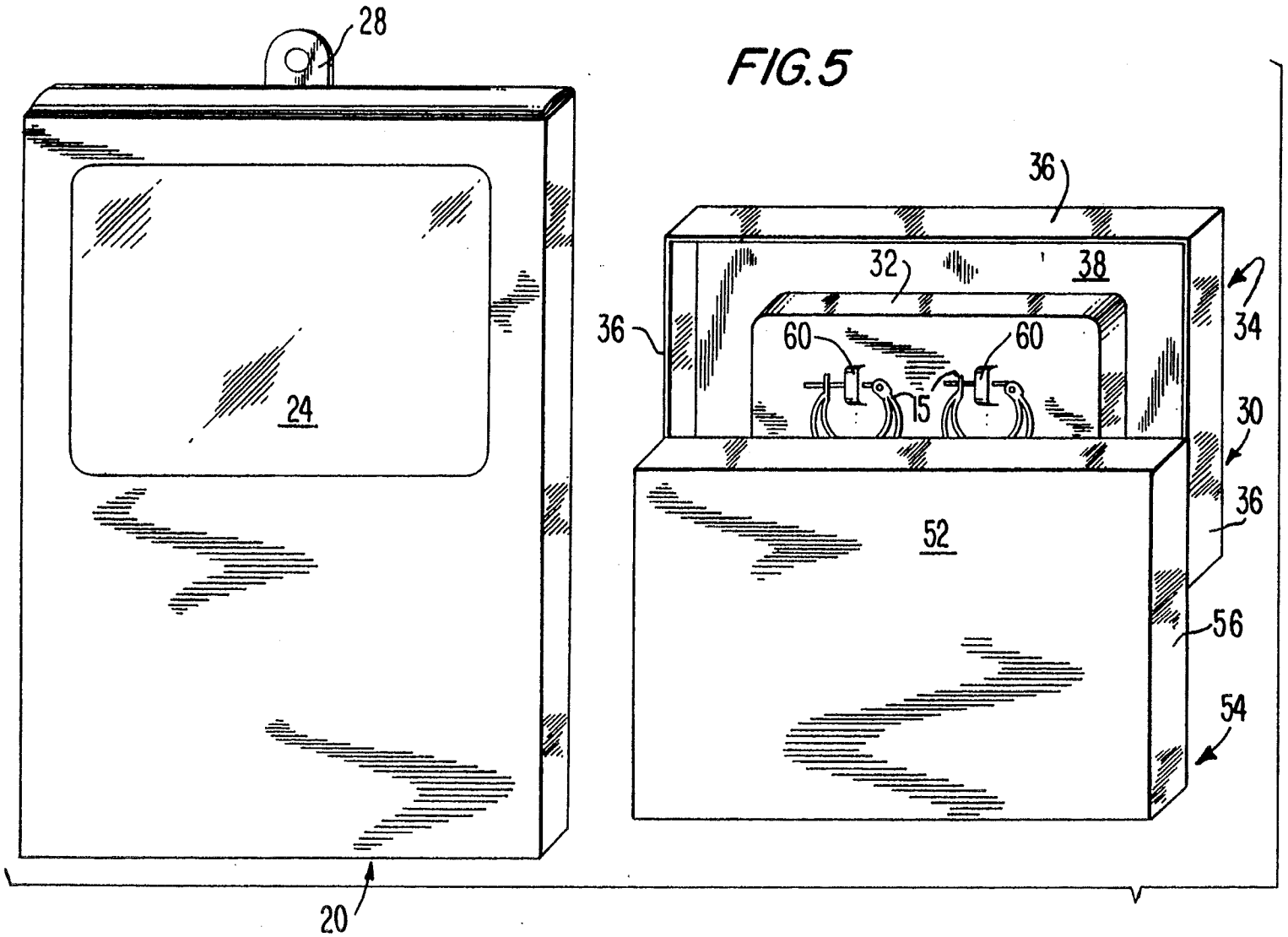
FIG. 5 is an exploded perspective view of an alternate embodiment of the invention, wherein the outer enclosure can be attached to a display rack.

Referring now to FIG. 5, upon removal of the bottom of the box (30) and the box top (54) from the outer enclosure (20), the box top (52) is dimensioned to fit onto the bottom of the box (30) and thereby enclose the article (15).

According to another embodiment of the invention, the display package (40) with a substantially transparent window (24) for viewing an article (15) may further comprise means (28) to attach the display package (40) to a display rack.

In one preferred embodiment of the present invention, the article to be displayed is an article of jewelry (e.g., a ring, earrings, a bracelet, a watch, a pin). The display means preferably comprises a retaining means (60) for retaining the article to be sold in a suitable position for display. The retaining means (60) may be any suitable means of attachment known to those skilled in the art. Examples include elastic retaining means, string, a ridge(s) formed in the display means (32) for tightly holding the article (15) in place, and the like. The display means (32) itself may be made suitably decorative by having a pattern printed thereon or attached thereto, or may be covered by a suitable material. In certain preferred embodiments wherein the article (15) to be sold is an article of jewelry, the display means (32) may be covered with felt, velvet, or a satin or silk-like material.

Obviously, numerous modifications and variations of the present invention are possible in light of the above teachings. It is therefore to be understood that within the scope of the claims appended hereto, the invention may be practiced otherwise than as specifically disclosed herein.

What is claimed is:

1. A package for displaying and storing an article, said package comprising:

an outer enclosure having a substantially transparent display window, said outer enclosure containing display means for holding an article to be displayed, said display means being arranged within said outer enclosure such that the article is viewable through said display window, said display means comprising a box bottom, said outer enclosure further containing a box top dimensioned to fit onto said box bottom to form a closed box for housing the article, said box bottom and said box top being situated in said outer enclosure with the box in a open condition whereby said box bottom and said box top form the box only when said box bottom and said box top are removed from said outer enclosure.

2. The package of claim 1, wherein said box top is arranged within said outer enclosure such that it maintains said box bottom in a suitable position such that the article to be displayed is visible through said display window.

3. The package of claim 1, wherein said box bottom includes a base and connected side walls, and said box top includes a top wall and connected side walls, said box top being fitted onto said box bottom within said outer enclosure such that said top wall of said box top is in close proximity to or contacts said base of said box bottom.

4. The package of claim 1, wherein the article to be displayed is jewelry.

5. The package of claim 1, further comprising means for attaching said package to a display rack.

6. The package of claim 1, wherein said display means further comprise retaining means for retaining the article to be sold in a desired position.

7. A package for displaying and storing an article, said package comprising:

an outer enclosure having a bottom wall, a top wall and side walls connected to said top and bottom walls, said top wall having a see-through portion arranged therein;

a removable inner box arranged within said outer enclosure, said inner box having a top and bottom portion, said bottom portion of said inner box comprising display means for retaining an article to be displayed, said bottom portion of said inner box being arranged such that the article is viewable through said see-through portion of said top wall of said outer enclosure, said top portion of said box being dimensioned to fit onto said bottom portion of said box to form a closed box for housing the article, said top portion of said box being arranged within said outer enclosure but not obstructing the view of the article to be displayed through said see-through portion of said outer enclosure, said bottom portion and said top portion being situated in said outer enclosure with the box in a open condition whereby said bottom portion and said top portion form the box only when said bottom portion and said top portion are removed from said outer enclosure.

8. The package of claim 7, wherein said bottom and top of said box are removable from said outer enclosure and are dimensioned to fit together and enclose the article when said top and bottom portions are removed from said outer enclosure.

9. The package of claim 7, wherein the article is jewelry.

10. The package of claim 7, further comprising means for attaching said package to a display rack.

11. The package of claim 7, wherein said display means further comprise retaining means for retaining the article to be sold in a desired position.

12. The package of claim 7, wherein said top portion is arranged within said outer enclosure such that it maintains said bottom of said box in a suitable position such that the article to be displayed is visible through said see-through portion.

13. The package of claim 7, wherein said bottom of said top portion includes a base and connected side walls, and said top portion includes a top wall and connected side walls, said top portion being fitted onto said bottom portion within said outer enclosure such that said top wall of said top portion is in close proximity to or contacts said base of said bottom portion.

14. A method for storing and displaying an article, said method comprising the steps of:

retaining an article to be displayed on a box bottom;

providing an outer enclosure with a see-through window;

removably arranging said box bottom within the outer enclosure such that said box bottom is aligned with the see-through window and the article is viewable therethrough; and removably enclosing a box top dimensioned to fit onto said box bottom within the outer enclosure such that it does not cover said box bottom and obstruct the view of the article through the see-through window.

15. The method of claim 14, further comprising removing said box top and said box bottom from said outer enclosure, and fitting said box top onto said box bottom to thereby enclose the article.

16. The method of claim 14, further comprising placing said box top within said outer enclosure such that it supports said box bottom in a desired position for viewing the article to be displayed through the see-through window.

17. The package of claim 1, wherein said display window extends substantially over only an open side of said box bottom and does not extend over said box top.

18. The package of claim 1, wherein said display window comprises a sheet of transparent plastic material.

19. The package of claim 1, wherein said box top constitutes positioning means for positioning said box bottom in alignment with said display window by spacing said box bottom from an inner surface of said outer enclosure.

20. The package of claim 1, wherein said box bottom has opposed side walls and said box top has opposed side walls, one of said side walls of said box top contacting an inner surface of said outer enclosure and another one of said side walls of said box top contacting one of said side walls of said box bottom to thereby support and position said box bottom at a distance from said inner surface of said outer enclosure.

21. The package of claim 1, wherein said box top does not cover said box bottom when said box top and said box bottom are arranged within said outer enclosure.

22. The package of claim 1, wherein said box top comprises an opaque material.

23. The package of claim 22, wherein said opaque material is cardboard.

* * * * *